US005524641A

United States Patent [19]

Battaglia

[11] Patent Number: 5,524,641

[45] Date of Patent: Jun. 11, 1996

[54] PROTECTIVE BODY APPLIANCE EMPLOYING GEODESIC DOME STRUCTURES

[76] Inventor: Arthur P. Battaglia, 1620 Jones St., Apt. 6, San Francisco, Calif. 94109

[21] Appl. No.: 348,354

[22] Filed: Nov. 30, 1994

[51] Int. Cl.[6] ..... A61F 5/37; A41D 13/00

[52] U.S. Cl. ..... 128/846; 2/2

[58] Field of Search ..... 128/845, 846, 128/877, 878, 879, 869; 602/19; 2/2, 22, 23, 24, 44, 45

[56] References Cited

U.S. PATENT DOCUMENTS

| | | | |
|---|---|---|---|
| 3,640,831 | 2/1972 | Gardner et al. . | |
| 3,945,042 | 3/1976 | Lobo . | |
| 4,099,269 | 7/1978 | Porner . | |
| 4,317,237 | 3/1982 | Porte . | |
| 4,475,552 | 10/1984 | Yoshihara . | |
| 4,599,747 | 7/1986 | Robinson | 2/44 |
| 4,706,675 | 11/1987 | Elkins . | |
| 4,709,692 | 12/1987 | Kirschenberg et al. . | |
| 4,848,047 | 7/1989 | Sneyd . | |
| 4,884,295 | 12/1989 | Cox | 2/44 |
| 4,926,883 | 5/1990 | Strock . | |
| 4,982,447 | 1/1991 | Henson | 2/44 |
| 4,991,230 | 2/1991 | Vacanti | 128/846 |
| 5,069,009 | 12/1991 | Suzuki . | |
| 5,129,101 | 7/1992 | Douglas | 2/45 |

*Primary Examiner* Michael A. Brown
*Attorney, Agent, or Firm* Richard T. Lyon

[57] ABSTRACT

A protective body appliance to prevent injury from external forces to the underlying regions of the wearer's body is provided. The self-contained, fully integrated vest employs geodesic dome structures attached to the vest at vulnerable points of the wearer's body as a superior means of protection from impact by outside forces. The vest can include an open-ended honeycomb material or a lattice structure. The attached geodesic domes can either be rigid, form-retaining domes or can be somewhat resilient and filled with foam.

19 Claims, 2 Drawing Sheets

PROTECTIVE BODY APPLIANCE EMPLOYING GEODESIC DOME STRUCTURES

BACKGROUND

1. Technical Field

This invention relates to a user-worn appliance to protect against bodily injury, and more particularly to a user-worn appliance that provides protection by a garment incorporating geodesic dome structures placed at vulnerable areas of the body.

2. Background Art

An important consideration for many individuals is protecting relatively vulnerable regions of their bodies from impact forces likely to be experienced in their particular environments, such as while playing sports.

It is well known that ice hockey requires hard body contact on the part of the participants, both with one another and the surface of the ice. Some forms of in-line or roller skating competitions make analogous demands on the participants. Other sports such as football also involve potentially injurious contact. As a result, protective padding is used under the uniforms worn by football and hockey players and other participants in contact sports.

Traditionally, the design and construction of sports body pads for the upper body, especially in the case of American football or hockey, has employed a semi-free floating shoulder plate. This design requires the use of a jersey as a means of shoulder pad containment to prevent interference (via the up and down flapping motion) while playing the game. However, not all skaters feel compelled to wear a hockey uniform when they skate, nor do all skaters play hockey. Additionally, people engage in backyard games, such as football, where no uniform or jersey is worn and where often no traditional padding is available.

Protective devices have been provided for many years and have previously been unusually heavy and cumbersome to move in. Materials used in past have been steel, fiberglass or other strong and heavy material. While these material have provided protection for various parts of the body, they have had the disadvantage in that they lack flexibility, making them difficult to conform to the body of the user, and have also been heavy and cumbersome to use. There have been some lighter padding types created. For instance, some padding types are comprised of laminated sheets of cushioning material, each sheet having adjacent trapped air pockets. However, these pads are prone to popping when impacted by a sharp instrument, for instance a rock. Hence, these pads would not really be suitable for applications such as backyard football or rollerhockey.

Also, most sports padding to date has not allowed air to flow through the padding. As a result, the padding is often very hot to conduct sports activity in, causing the wearer undue discomfort.

Additionally, various individual appliances have been suggested to protect localized body portions from external forces. These non-integrated appliances, however, only provide limited protective coverage and normally require adhesive to secure them. Most of these appliances have a pad adhesively secured to the wearer and a rigid shield secured to the pad. The shield is configured to absorb and disperse external forces to which it is exposed, so as to prevent the underlying vulnerable body region from suffering from their effects. One major limitation of many prior adhesively secured protective appliances is that they tend to "wear" off the user with time. Simple body movements cause sections of the adhesively secured pad to be pulled away from the skin. Though the sections may re-adhere to the body, the bonding strength of the adhesive is substantially weakened. Over time, the adhesive securing the appliance becomes so weak it can no longer hold it to the body. As a result, the appliance falls off the user and usually has to be replaced. As a consequence, these localized adhesive pads are really not suitable for contact sports or sports where the player is moving constantly and cannot anticipate which area of his body will be subject to impact.

Therefore, what is needed is a fully integrated protective body appliance that is light, flexible and durable and which would allow air flow through to provide ventilation.

SUMMARY

Wherefore, it is an object of the present invention to provide padding that is integrated into a garment, thereby obviating the need for jersey or other containment of shoulder pads.

Wherefore, it is an object of the present invention to provide lighter, durable body protection by utilizing the inherently high strength per weight ratio of the geodesic dome structure.

Wherefore, it an another object of the present invention to provide a body protective appliance which allows air flow through the appliance for ventilation.

These and other objects and advantages of this invention will become apparent to those skilled in the art from the following description of preferred forms thereof, and the illustrations set forth herein.

The foregoing objects have been attained by a flexible vest that incorporates geodesic domes placed at vulnerable points of the body to dissipate the impact of a fall or contact with another sports participant. The flexible, shock absorbing vest is zippered to the upper body. The appliance will protect the chest, shoulders, ribs, sides and back utilizing geodesic domes to receive and safely distribute a severe localized impact over a relatively large area. This invention will provide the wearer protection from impact during contact sports of various kinds.

In the preferred embodiment of this invention, rigid, form retaining geodesic domes protect the wearer from impact during sports activities. These geodesic domes are attached to a base vest that is approximately one and a half inches deep. The vest covers the front ribs, solar plexus, shoulders and extends to the midpoint of the wearer's back. The base vest also utilizes a honey comb foam structure for strength. The open honeycomb structure also assists in ventilation as the air can flow through. There is also a front zipper closure to keep the vest snug to the upper body. There are two geodesic domes placed at the upper left and right chest area, respectively, that protect the upper chest. There are also two geodesic shoulder domes astride the left and right shoulders. There are two rib geodesic domes placed below the chest domes for protection of the left and right sides of the front rib cage areas. Additionally, there are two side domes, one each at the left and right sides of the vest to protect the wearer's sides. The back of the vest includes four smaller spinal geodesic domes aligned with the spine to provide protection from the neck to the middle-back area of the spine. Left and right shoulder-blade domes, separate and distinct from the shoulder domes, protect the wearer's shoulder blades. All domes are attached by being sewn onto the base vest. The outermost layer of the vest, as well as the attached domes may be sheathed in a nylon mesh, which has an open weave so as to allow air to flow through. This covering material also prevents the domes from serving as a fingerhold in contact sports.

The geodesic structures in the preferred embodiment of the invention are rigid, form retaining structures which are molded of hardened nylon or vinyl plastic or other suitable materials.

Advantages of this design are many fold. Designing this vest as an integrated unit obviates the need for a jersey to contain the padding. The geodesic domes have a unique property of a high strength to weight ratio that provides superior protection, while being extremely light weight. Thus, the geodesic dome padding will be stronger and lighter than other pads now used. Additionally, the open structures of the domes and the honey comb vest will allow air to flow through the padding. The vest can also be easily tailored for different sports and other applications by attaching geodesic domes in locations likely to be impacted. Further, the application of geodesic domes to other areas of the body such as arms, elbows, legs, knees, hips, thighs, tailbone and head by incorporation or adaptation into existing padding may again afford lighter and stronger versions of the padding and helmets that already exist.

An alternate embodiment of the present invention has geodesic domes contained at the same locations as the preferred embodiment, but the geodesic domes of the alternate embodiment are more flexible and resilient, and are filled with foam. The geodesic domes of the alternate embodiment will initially retain their shape on impact, but then will yield somewhat, thereby absorbing some of the impacting force. The foam inside the geodesic shell will also help to absorb the force and will assist in pushing the resilient geodesic domes back into their original shape. Although this design may be somewhat heavier and provide less ventilation, these alternate geodesic dome structures may serve to better absorb and disperse the impacting force.

In another alternate embodiment, the vest base uses a girder lattice structure vice a honeycomb structure. The geodesic dome structures of this design could be either the open type or the foam-filled type.

Accordingly, it can be seen that all the stated objectives of the invention have been accomplished by the above-described embodiments of the present invention. In addition, other objectives, advantages and benefits of the present invention will become apparent from the detailed description which follows hereinafter when taken in conjunction with the drawing figures which accompany it.

DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

Preferred embodiments of the present invention will now be described with reference to the drawings.

Figure 1:
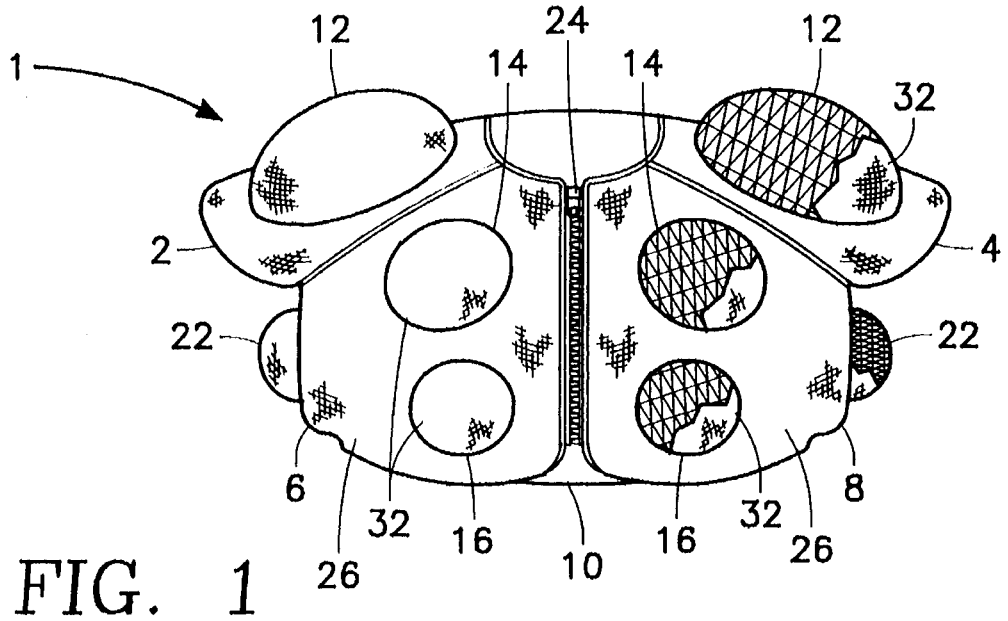
FIG. 1 is a front view of the preferred embodiment of the invention. Shown are a base vest with attached geodesic domes and a mesh material covering that is cut away from some of the geodesic domes.

FIG. 1 shows a frontal view of the preferred embodiment. The base vest I is composed of five panels: right and left shoulder panels 2, 4; right and left chest panels 6, 8, and back panel 10 (shown in FIG. 2). Panels 2, 4, 6 and 8 are visible from the front. The base vest 1 is approximately one and a half inches deep and covers the front ribs, solar plexus, shoulders and extends to the midpoint of the wearer' back. There are two shoulder domes 12, one each attached onto the right and left shoulder panels 2, 4 respectively. Additionally, two chest domes 14, attached to the right and left chest panels 6, 8 respectively, protect the upper left and right chest from impact. These shoulder and chest domes 12,14 are covered with material 32. Domes 12, 14, 16, 22 on one side of the vest are shown in FIG. 1 with the material covering 32 intact on one side, and with the material covering 32 cut away on the other side. There are two rib domes 16 attached below the chest domes on right and left chest panels 6, 8. These rib domes 14 are also covered with material 32. There is a front zipper closure 24 between panels 6 and 8 to keep the vest snug to the upper body.

Figure 2:
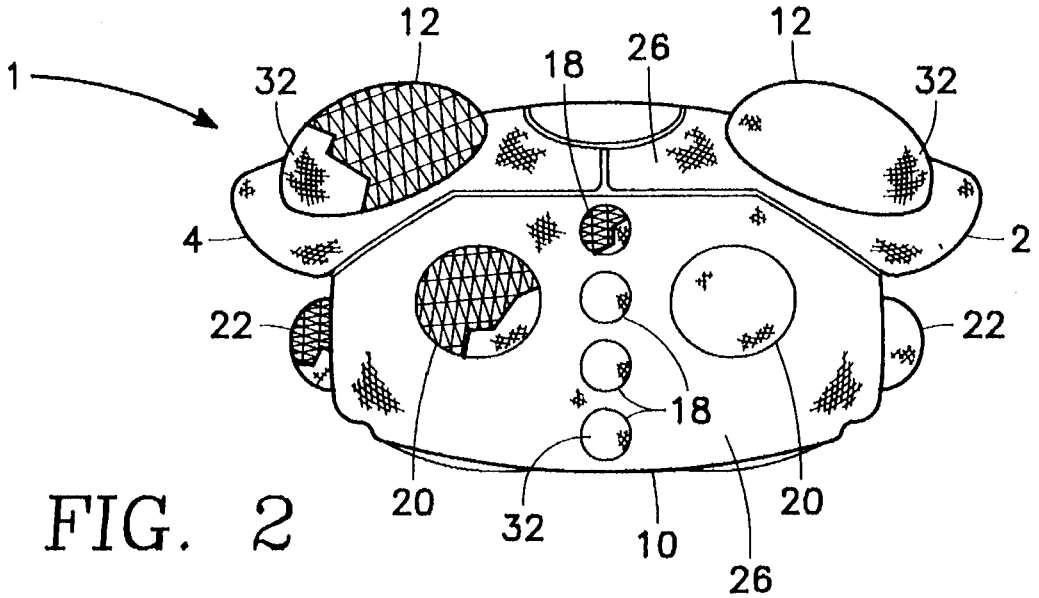
FIG. 2 is a rear view of the embodiment of FIG. 1 showing the back of the base vest with attached geodesic domes and a mesh material covering that is cut away from some of the geodesic domes.

Four smaller spinal domes 8 are attached to the back panel 10 and aligned with the spine to provide protection from the neck to the middle-back area of the spine, as shown in FIG. 2. Left and right shoulder blade geodesic domes 20, separate and distinct from the shoulder domes 12, are also attached to back panel 10 to protect the wearer' shoulder blades. FIG. 2 shows the material covering 32 of the attached domes cut away on one side and intact on the other side of the vest.

Figure 3:
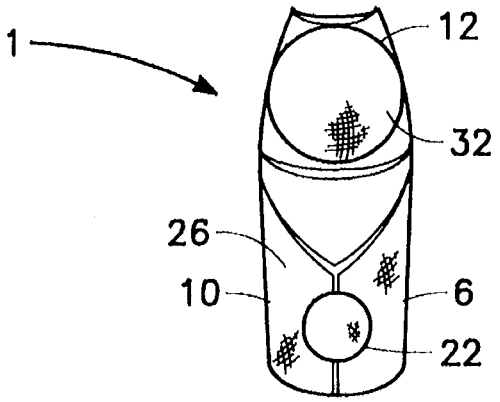
FIG. 3 is a side view of the embodiment of FIG. 1 showing the side of the base vest with attached geodesic domes and a mesh material covering.

There are also left and right side domes 22 placed for protection of the left and right sides of the wearer. The right side dome 22 is shown in FIG. 3. The left side dome 22 straddles the left chest panel 8 and the back panel 10, while, as can be seen in FIG. 3, the right side dome 22 straddles the right chest panel 6 and the back panel 10.

Figure 4:
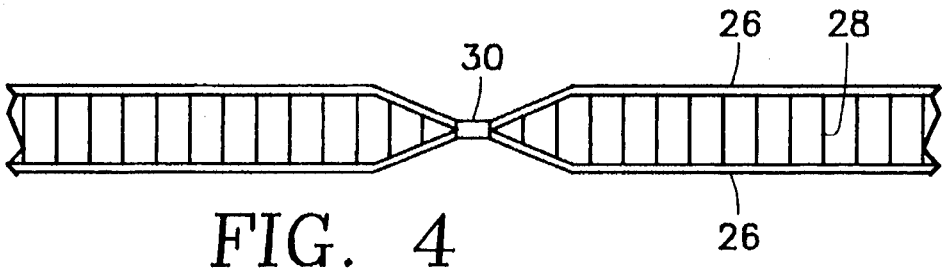
FIG. 4 is a cross-sectional view of a honeycomb layer of the base vest of Figure I in which a sewn and heatwelded seam is shown.
Figure 5:
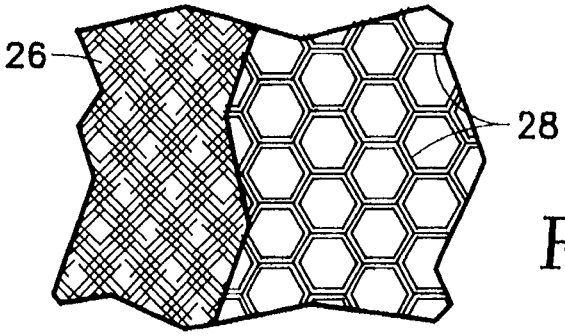
FIG. 5 is a top view of a small portion of the honey comb vest base of Figure I with the outer covering partially cut away.

Each panel 2, 4, 6, 8 10 of the vest I has a core 28 covered on both sides with material 26, as shown in FIG. 4. The material 26 protects the core 28 and allows air to freely flow. This material is preferably an open weave such as a nylon mesh. The core is preferably a honeycomb structure made of foam. The foam is resilient and will yield to the force of an impact, but has sufficient stiffness to absorb enough of the energy of a typical sports related impact to prevent injury to the wearer. A suitable foam for this application, for example, would be a Crosslinked Polyolefin. The foam core 28 is open ended to allow air to flow through it. The panels are secured to each other by sewing, and then heat welding, forming seams 30. FIG. 5 shows a top view of a small circular portion of a base vest panel with material covering 26 cut away so that honeycomb structure 28 is visible.

The domes 12, 14, 16, 18, 20, 22 are geodesic structures. In the preferred embodiment of the invention they are rigid, form retaining geodesic structures which are molded of hardened nylon or vinyl plastic. As previously described, the geodesic dome structures 12, 14, 16, 18, 20, 22 will be covered with a material 32 to prevent the geodesic domes 12, 14, 16, 18, 20, 22 from serving as a finger hold in contact sports. All domes 12, 14, 16, 18, 20, 22 are meant to be attached by being sewn onto the base vest 1. However, the domes could alternately be attached via grommet or rivet.

Figure 6:
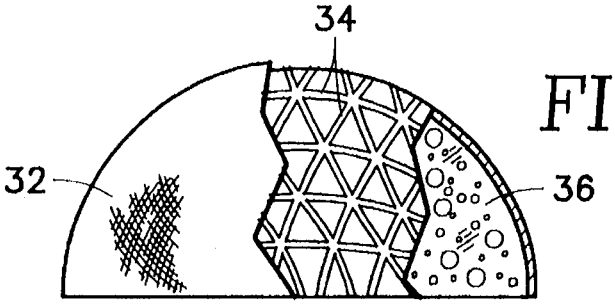
FIG. 6 is a view of the alternate embodiment of the geodesic domes that are foam filled. The figure is partially cut away to show the outer covering, the geodesic dome structure and the foam filling.

FIG. 6 shows a side view of a geodesic dome of an alternate embodiment of the present invention. The alternate embodiment has geodesic domes 34 contained at the same locations as the preferred embodiment, but the geodesic domes 34 of the alternate embodiment are somewhat flexible and resilient structures, and are filled with a resilient foam. The domes 34 of the alternate embodiment are also covered with material 32. The geodesic shells of the alternate embodiment will initially retain their shape on initial impact of a force, but then will yield somewhat depending on the strength of the impacting force. The foam 36 inside the geodesic dome of the alternate embodiment will help to absorb the impacting force and will assist in pushing the flexible and resilient geodesic domes 34 back into their original shape. A suitable foam for this application, for example, would be a soft open-celled foam made of Polyether. A company, Crane, makes this in various degrees of resiliency. Another kind of suitable foam would be Polyethelene Ethafoam. Although this design may be somewhat heavier and less ventilated, the impact absorbing foam 36 should serve to better absorb and disperse the impacting force.

Figure 7:
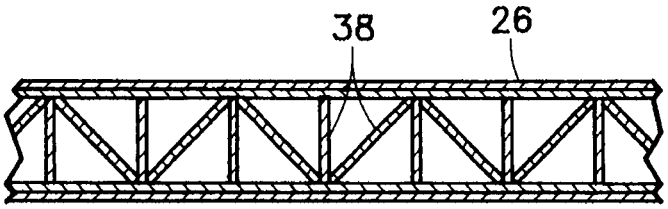
FIG. 7 is a cross-sectional view of the base vest which utilizes a girder lattice structure.
Figure 8:
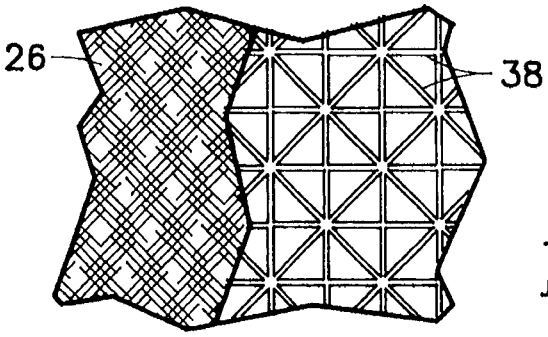
FIG. 8 is a top view of a small part of the base vest which utilizes a girder lattice structure of FIG. 7. A part of the outer material is cut away.

In another alternate embodiment, the base vest I uses a girder lattice structure 38 vice a honeycomb structure 28. FIG. 7 shows a cross-sectional view of a base vest panel of this alternate embodiment. Load bearing truss members 38 are placed vertically within the plane of the base vest I and other truss members 38 are placed from the base of one truss member 38 to the top of another, creating a triangular lattice framework. The truss members 38 of this alternate embodiment could be made of hardened nylon or vinyl plastic or other suitable materials. Optionally, these truss members 38 could be covered with a soft foam coating for comfort. The geodesic dome structures of this alternate embodiment could be of the open design type or the type filled with foam. FIG. 8 shows a top view of a small circular section of this embodiment of the invention with the material covering 26 partially cut away so that the truss lattice members 38 are visible.

While the invention has been described in detail by reference to the preferred embodiments described above, it is understood that variations and modifications thereof may be made without departing from the true spirit and scope of the invention. For example, incorporation of geodesic domed padding or structures into sports body pads for the lower torso, legs arms, and even head could again provide a superior means of protection of current designs. Additionally, the invention could be modified to create padding designed for specific sports, placing geodesic domes in areas that are likely to be impacted in that type of sport. Applications of soft foam padding utilizing the geodesic shape to crotch, buttock or breast areas of under or outergarments could be devised. Young children who are prone to falling down during their early developmental years might benefit from this invention. Additionally, the elderly, who are prone to serious injury when falling, might also benefit from an adaptation of this invention. Also, the vest base could be made to be a single unit, vice a paneled design. Another modification of the invention might be envisioned where the domes are partially recessed into the vest so that they do not protrude as far.

Wherefore, what is claimed is:

1. A protective body appliance comprising:

(a) an impact absorbing and dispersing garment;

(b) impact absorbing and dispersing geodesic domes; and, (c) means for connecting the geodesic domes to the garment.

2. The protective body appliance of claim 1 wherein the garment is a vest.

3. The protective body appliance of claim 2 wherein the vest is comprised of panels connected together.

4. The protective body appliance of claim 3 wherein the panels comprise a left and right front panel, two shoulder panels and a back panel.

5. The protective body appliance of claim 3 wherein the panels comprise an open-ended honey comb core with the open ends facing a user's body and the other open ends facing the exterior of the panel.

6. The protective body appliance of claim 5 wherein the panels further comprise a material covering over the interior and exterior surfaces of the panel.

7. The protective body appliance of claim 6 wherein the material covering comprises an open-weave to allow air to pass through.

8. The protective body appliance of claim 3 wherein the panels comprise a lattice work of truss members.

9. The protective body appliance of claim 8 wherein the lattice work truss members are coated with foam.

10. The protective body appliance of claim 1 wherein the geodesic domes are covered with material to prevent them serving as a finger holds.

11. The protective body appliance of claim 10 wherein the material is open-weave to allow air to pass through.

12. The protective body appliance of claim 1 wherein the geodesic dome comprises a rigid, form retaining material.

13. The protective body appliance of claim 12 wherein the geodesic dome material is a hardened nylon or vinyl plastic.

14. The protective body appliance of claim 1 wherein the geodesic domes comprise a resilient material capable of deforming under impact and absorbing the energy of the impact.

15. The protective body appliance of claim 14 wherein the geodesic domes are filled with resilient shock-absorbing foam.

16. The protective body appliance of claim 1 wherein the connecting means comprises thread wherein the geodesic domes are sewn to the garment.

17. The protective body appliance of claim 1 wherein the connecting means comprises rivets wherein the geodesic domes are riveted to the garment.

18. The protective body appliance of claim 1 wherein the connecting means comprises grommets whereby the geodesic domes attached to the garment with grommets.

19. The protective body appliance of claim 1 wherein the garment comprises a unitary garment.

* * * * *